US006279763B1

(12) United States Patent
Bush

(10) Patent No.: US 6,279,763 B1
(45) Date of Patent: Aug. 28, 2001

(54) COLLAPSIBLE PALLET RACK

(76) Inventor: Jeffrey Bush, 13640 Brynwood La., Fort Myers, FL (US) 33912

( * ) Notice: Subject to any disclaimer, the term of this patent is extended or adjusted under 35 U.S.C. 154(b) by 0 days.

(21) Appl. No.: 09/523,204

(22) Filed: Mar. 10, 2000

(51) Int. Cl.[7] ..... A47F 7/00

(52) U.S. Cl. ..... 211/195; 211/194; 211/85.5; 108/55.1

(58) Field of Search ..... 211/195, 194, 211/85.5; 108/55.1, 53.1, 57.31

(56) References Cited

U.S. PATENT DOCUMENTS

| | | | | |
|---|---|---|---|---|
| 2,699,911 | * | 1/1955 | Chase et al. . | |
| 2,954,197 | * | 9/1960 | Laird . | |
| 2,956,763 | | 10/1960 | D'Arca . | |
| 2,962,167 | * | 11/1960 | Storey et al. | 211/85.5 |
| 3,084,803 | | 4/1963 | Bayers . | |
| 3,355,029 | | 11/1967 | Eurey . | |
| 3,430,773 | | 3/1969 | Hancock . | |
| 3,499,398 | * | 3/1970 | Murray . | |
| 3,565,018 | * | 2/1971 | Jay . | |
| 3,804,033 | | 4/1974 | Izawa et al. . | |
| 3,857,494 | * | 12/1974 | Giardini . | |
| 4,098,409 | | 7/1978 | Massey . | |
| 4,773,547 | * | 9/1988 | Bell | 211/194 |
| 5,228,821 | | 7/1993 | Gleffe et al. . | |
| 5,242,255 | | 9/1993 | Gleffe et al. . | |
| 5,507,237 | * | 4/1996 | Barrow et al. | 108/55.1 |
| 5,692,625 | | 12/1997 | Filipescu et al. . | |
| 5,941,398 | | 8/1999 | Harris . | |

* cited by examiner

*Primary Examiner*—Robert W. Gibson, Jr.
(74) *Attorney, Agent, or Firm*—Oblon, Spivak, McClelland, Maier & Neustadt, P.C.

(57) ABSTRACT

A collapsible and stackable pallet rack is provided for shipping and storing heavy roll goods having a central mandrel. The rack includes two pairs of adjacent and opposite upright corner posts being foldable inwardly and downwardly. Two side bars connect together the pair of opposite upright corner posts. There are also two pairs of upper and lower end bars. Each pair of end bars connect together one pair of adjacent upright corner posts. On top of each upper end bar, there is one cradle positioned centrally thereon for receiving one end of the central mandrel. A holddown plate is fastened on top of each cradle. Two pairs of hinge plates connect the two pairs of corner posts with the two side bars. This rack provides a shipping unit that prevents damage to heavy roll goods during transit and simultaneously provides a cost-effective stackable storage unit.

5 Claims, 5 Drawing Sheets

COLLAPSIBLE PALLET RACK

BACKGROUND OF THE INVENTION

1. Field of the Invention

This invention relates generally to collapsible pallet racks and more particularly to a collapsible and stackable steel rack for shipping and storing heavy roll goods.

2. Description of the Related Art

Collapsible steel pallet racks were first developed in the late 1950s by the Clark Equipment Co. of Battle Creek, Mich., to replace wooden pallets for storing and transporting heavy awkward articles, such as automobile engines. An exemplary prior art steel pallet is shown in U.S. Pat. No. 2,956,763 which issued on Oct. 18, 1960, to Nicholas D'Arca.

During the 1960s, the textile industry developed various heavy duty, strong racks for yarn-carrying beams. Examples are given in U.S. Pat. No. 3,084,803 which issued to Bayers on Apr. 9, 1963; in U.S. Pat. No. 3,355,029 which issued to Eurey on Nov. 28, 1967; and in U.S. Pat. No. 3,430,773 which issued to Hancock on Mar. 4, 1969.

During the 1970s, improved foldable shipping racks for heavy items, such as automobile engines, were developed in both the United States and Japan. Such racks are shown in U.S. Pat. No. 3,804,033 which issued to Izawa et al. on Apr. 16, 1974, and in U.S. Pat. No. 4,098,409 which issued to Massey on Jul. 4, 1978. These developments were satisfactory to carry industry through the 1980s.

However, during the 1990s, a need developed for more durable, reusable, foldable, transporting and packaging racks for mechanically sensitive goods in the form of large rolls. This need was met by various racks manufactured in both the United States and Germany. Such racks are illustrated by U.S. Pat. No. 5,228,821 which issued to Gleffe et al. on Jul. 20, 1993; U.S. Pat. No. 5,242,255 which also issued to Gleffe et al. on Sep. 7, 1993; U.S. Pat. No. 5,692,625 which issued to Filipescu et al. on Dec. 2, 1997; and U.S. Pat. No. 5,941,398 which issued to Harris on Aug. 24, 1999.

SUMMARY OF THE INVENTION

A primary object of the present invention is to provide a collapsible and a stackable pallet rack with a hinged arrangement that allows the rack to fold inwardly and downwardly at its sides. This rack provides a shipping unit that prevents damage to heavy roll goods during transit and simultaneously provides a cost-effective stackable storage unit.

A secondary object of the present invention is to provide a cradle that includes a holddown plate which prevents a mandrel from accidently coming off during transit. The cradle has a deep inset and the holddown plate are innovative to collapsible pallet racks. Thus, the present invention returns freight shipping efficiencies not obtainable with prior art devices.

A tertiary object of the present invention is to use cotter pins to secure upright corner posts in the rack. Such cotter pins are placed above the hinges and are included as a basic safety feature. Another safety feature is the use of trapezoidal foot plates reinforced with seven-gauge angle iron to provide added strength in stacking the racks in a nesting arrangement.

In summary, the present invention is a pallet formed of steel in a manner like no other in the industry. It should provide manufacturers and users of large volume papers and films with an economical way to handle a reusable product.

Furthermore, the present invention is intended to replace the use of end boards, wooden pallets and cardboard or plastic core plugs that have a limited life and perform only marginally in protecting large product rolls during shipment and storage.

DETAILED DESCRIPTION OF THE INVENTION

Figure 1:
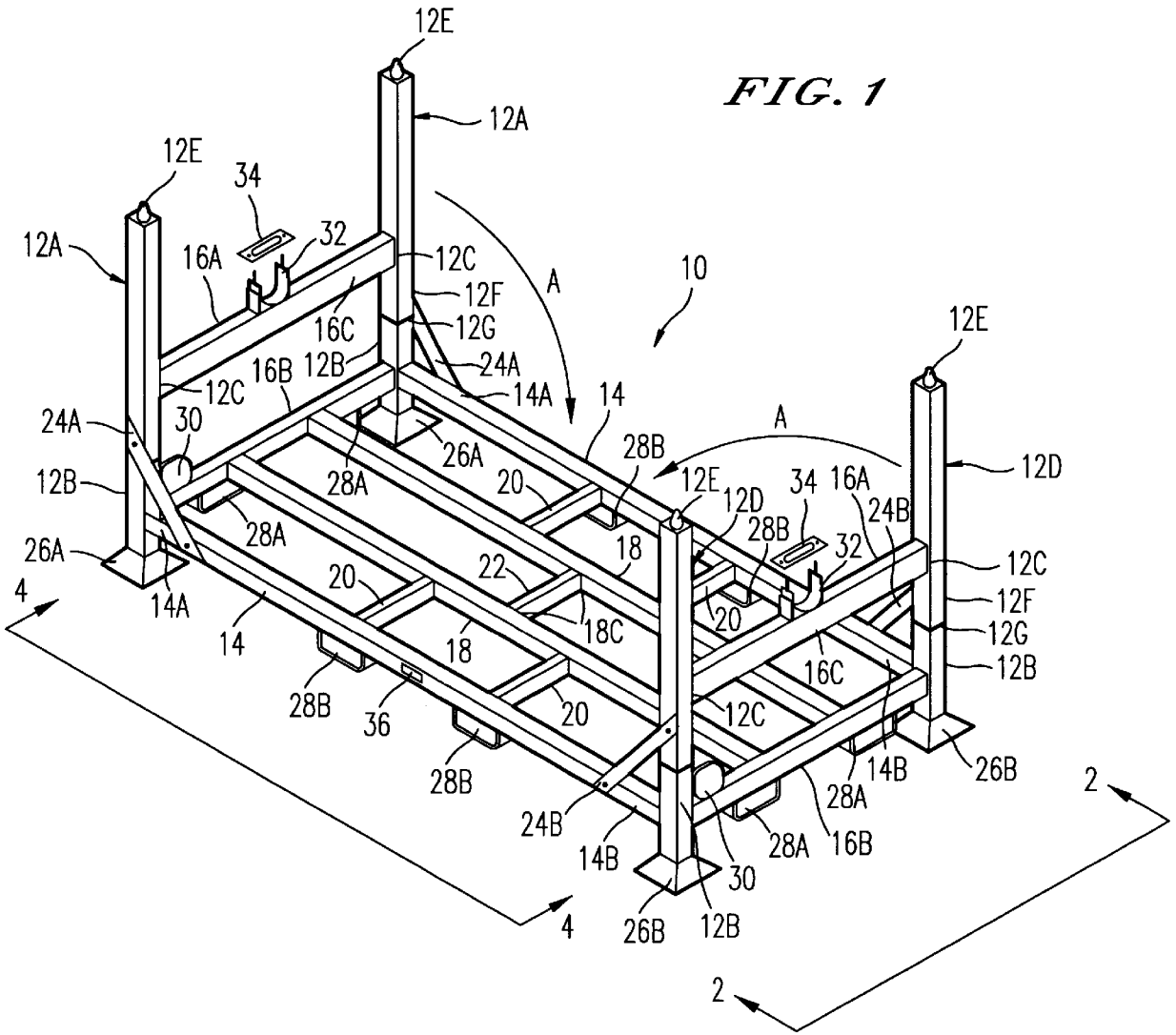
FIG. 1 is a perspective view of the invention.

In FIG. 1, a stackable pallet rack 10 is made of steel and is shown in its uncollapsed position. The rack 10 has two pairs of upright corner posts 12A and 12D which are foldable inwardly and downwardly in a direction of arcuate arrows A. Two long side bars 14 connect opposite corner posts 12A and 12D at their bottom ends 12B. Each of the corner posts 12A and 12D has an upper end 12F which sits in each bottom end 12B at a seam 12G. A pair of short upper end bars 16A connects adjacent pairs of corner posts 12A and 12D together at their vertical centers 12C while a pair of short lower end bars 16B connects the same adjacent posts 12A and 12D together at their bottom ends 12B. Two long middle bars 18 run parallel to the two long side bars 14 and connect opposite lower end bars 16B together. A plurality of short cross braces 20 connects each middle bar 18 to its adjacent side bar 14 while at least one middle brace 22 connects the two middle bars 18 together at their centers 18C. Together, the two long side bars 14, the two long middle bars 18, the plurality of short cross braces 20 and at least one middle brace 22 form a rigid bed-like structure like no other in the industry. A pair of hinge plates 24A connects the pair of corner posts 12A to one end 14A of the side bars 14 while another pair of hinge plates 24B connects the pair of corner posts 12D to another end 14B of the side bars 14. A pair of trapezoidal foot plates 26A receives the bottom ends 12B of the one pair of corner posts 12A while another pair of trapezoidal foot plates 26B receives the bottom ends 12B of the opposite pair of corner posts 12D. A pair of brackets 28A is secured below each of the lower end bars 16B while another pair of brackets 28B is secured below each side bar 14. The brackets 28A and 28B receive prongs of a forklift (not shown) to allow an operator to lift a rack 10 safely. Thus, because the brackets 28A and 28B are located on all sides of the rack 10, the forklift operator may enter the rack 10 in any one of four directions to remove the rack 10 from a stack thereof. Each of the corner posts 12A and 12D has a top end pin 12E which projects into an underside of each of the foot plates 26A and 26B of another rack (not shown) placed on top of the rack 10 to build a stable stack. A rectangular box 30 is mounted on top of each lower end bar 16B near to the bottom end 12B of one of the posts 12A and one of the posts 12D. These boxes 30 aid in preventing a large roll (not shown) from shifting in the rack 10. A cradle 32 is positioned on top of each upper end bar 16A at their horizontal centers 16C. A holddown plate 34 is fastened on top of each cradle 32 to prevent a central mandrel (not shown) of a large roll (also not shown) from jumping out of the cradle 32 in the event that the rack 10 would receive a strong shock from an external force, such as a forklift or an earthquake. A name plate 36 may be provided along the side bar 14 to identify either the manufacturer or the owner of each rack 10.

Figure 2:
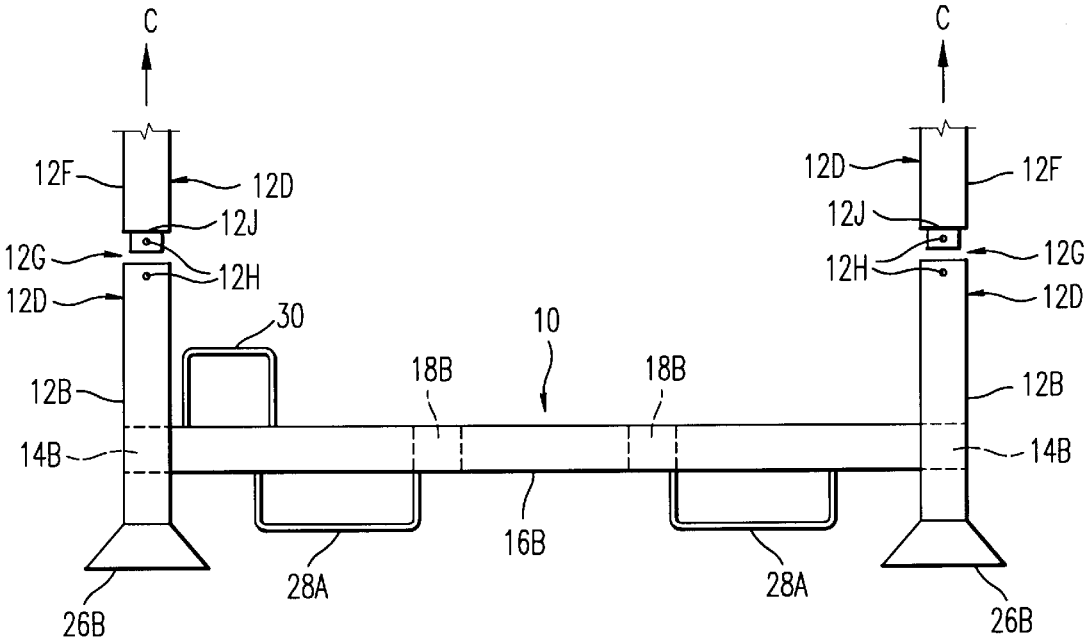
FIG. 2 is a partial lower end view taken along line 2—2 of FIG. 1.

FIG. 2 is a lower end view of the rack 10 taken along line 2—2 of FIG. 1. FIG. 2, the corner posts 12D are joined at their bottom ends 12B by the lower end bar 16B. The corner posts 12D sit in the pair of trapezoidal foot plates 26B. The ends 14B of the side bars 14 (not shown) are seen in phantom lines. Likewise, ends 18B of the middle bars 18 (not shown) are illustrated in phantom lines. The brackets 28A and the boxes 30 are seen below and above, respectively, the end bar 16B. Also, the placement of the upper ends 12F into the bottom ends 12B of the corner posts 12D at the seam 12G is clearly shown. Bore holes 12H are drilled in alignment with each other at a top of each bottom end 12B and in a mating block 12J of each upper end 12F of the corner posts 12D so that a cotter pin (not shown) may be pushed therethrough to secure the upper end 12F to the bottom end 12B of each corner post 12D at the seam 12G.

Figure 3:
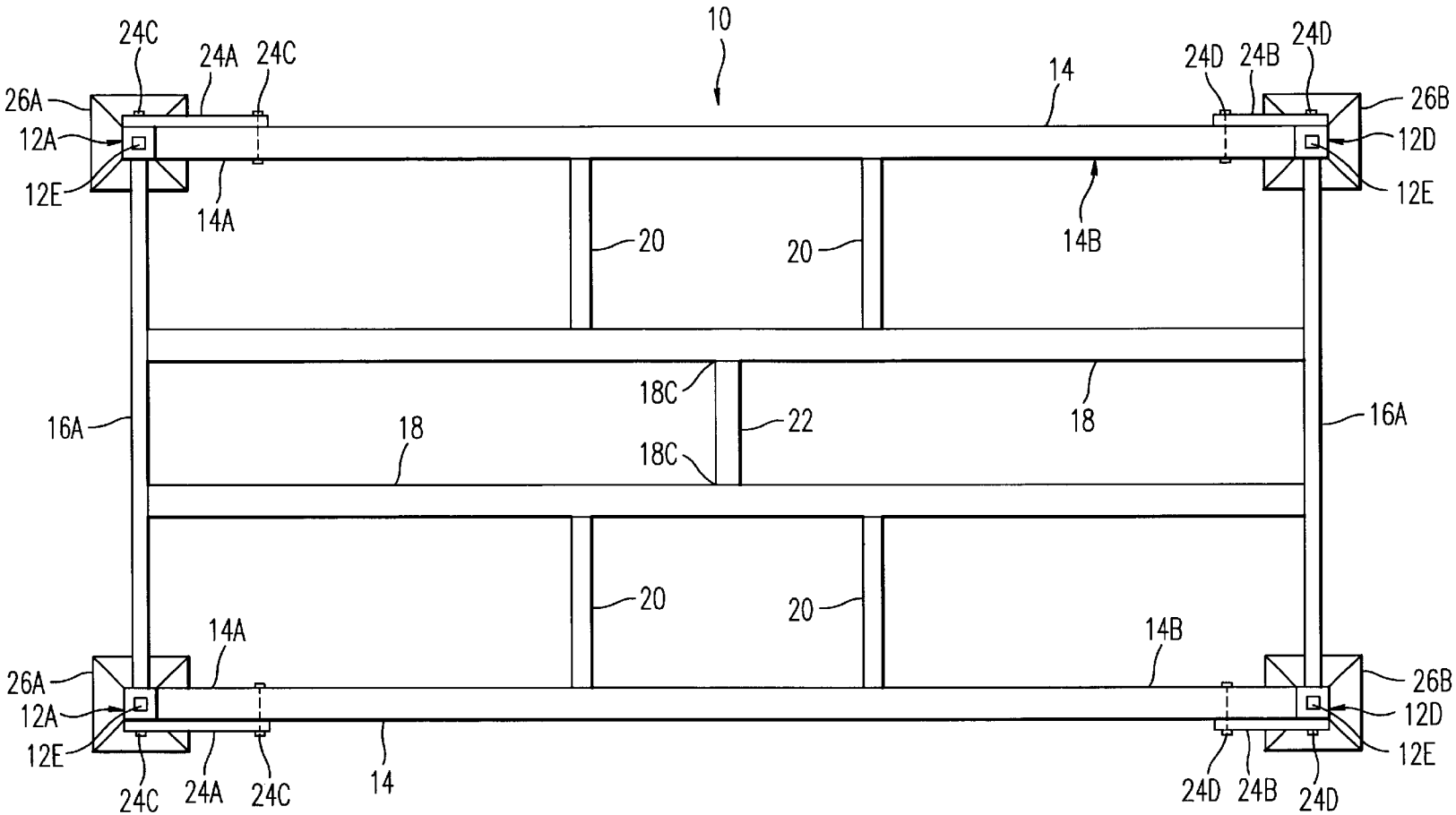
FIG. 3 is a top plan view of the invention.

In FIG. 3, a top plan view of the rack 10 is shown with the corner posts 12A and 12D, each having the top end pin 12E. The trapezoidal foot plates 26A and 26B are made of seven-gauge angle iron. The upper end bars 16A connect each adjacent pair of corner posts 12A and 12D together. The side bars 14 connect one corner post 12A to the opposite corner post 12D. The pair of middle bars 18 extends parallel to the side bars 14 and is joined at their horizontal centers 18C by the middle brace 22. The pair of cross braces 20 joins each of the middle bars 18 to the adjacent side bar 14. The one pair of hinge plates 24A connects the one end 14A of each side bar 14 to one of the corner posts 12A while the other pair of hinge plates 24B connects the other end 14B of each side bar 14 to the other of the corner posts 12D. One pair of top and bottom hinge pins 24C connect opposite ends of each hinge plate 24A between the one end 14A of each side bar 14 and one of the corner posts 12A. Likewise, another pair of top and bottom hinge pins 24D connect opposite ends of each hinge plate 24B between the other end 14B of each side bar 14 and one of the corner posts 12D.

Figure 4:
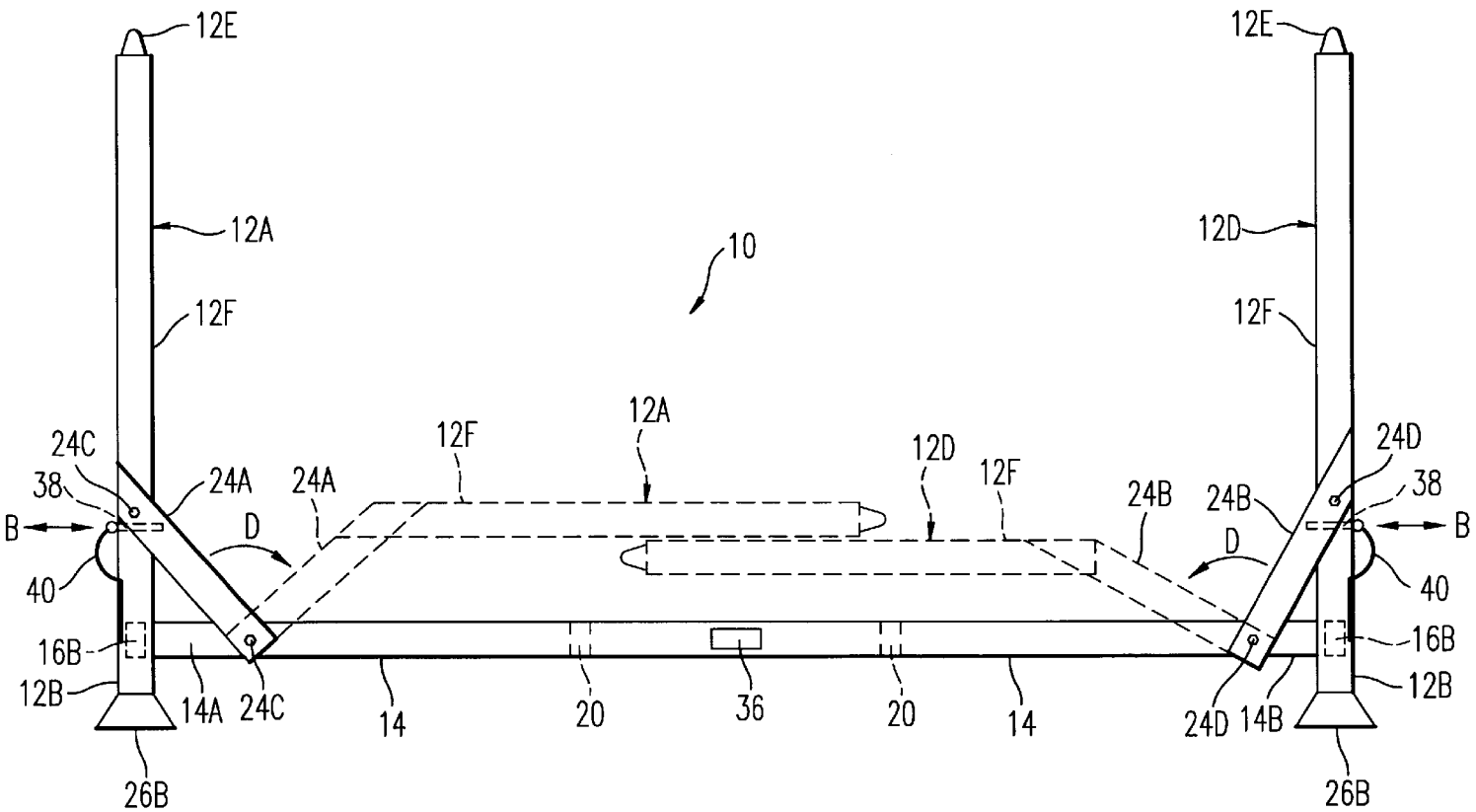
FIG. 4 is a side elevational view taken along line 4—4 of FIG. 1.

FIG. 4 is a side elevational view of the rack 10 taken along line 4—4 of FIG. 1. In FIG. 4, opposite corner posts 12A and 12D are mounted in their foot plates 26B. Each of the posts 12A and 12D has the end pin 12E on top. The side bar 14 connects the opposite corner posts 12A and 12D at their bottom ends 12B. Ends of the lower bars 16B and the cross braces 20 are shown in phantom lines. The name plate 36 is mounted at the middle of the side bar 14. Hinge plates 24A and 24B are shown in solid lines attached to the upper ends 12F of the corner posts 12A and 12D, respectively, in their upright positions. Hinge pins 24C and 24D secure the hinge plates 24A and 24B, respectively, at opposite ends 14A and 14B of the side bar 14 with the upper ends 12F of the corner posts 12A and 12D, respectively.

The collapsing of the pallet rack 10 may be best understood with reference to FIGS. 2 and 4. In FIG. 4, the rack 10 is shown with its corner posts 12A and 12D in their upright positions. In order to collapse the rack 10 into its folded position seen in phantom lines in FIG. 4, cotter pins 38 are pulled out in a direction of double-headed arrows B from aligned bore holes 12H of FIG. 2 and the upper ends 12F of the corner posts 12A and 12D are pulled slightly upwardly in a direction of arrows C in FIG. 2 to separate them at the seams 12G from the bottom ends 12B.

Returning to FIG. 4, the hinge plates 24A and 24B are then rotated 90° about the bottom hinge pins 24C and 24D, respectively, in a direction of arcuate arrows D. At the top hinge pins 24C and 24D, the hinge plates 24A and 24B each carry with them the upper ends 12F of the corner posts 12A and 12D which likewise rotate 90° from their upright positions to horizontally collapsed positions shown in phantom lines. The cotter pins 38 are not lost during the folding steps because they are retained by wires 40 which are secured to sides of the bottom ends 12B.

Figure 5:
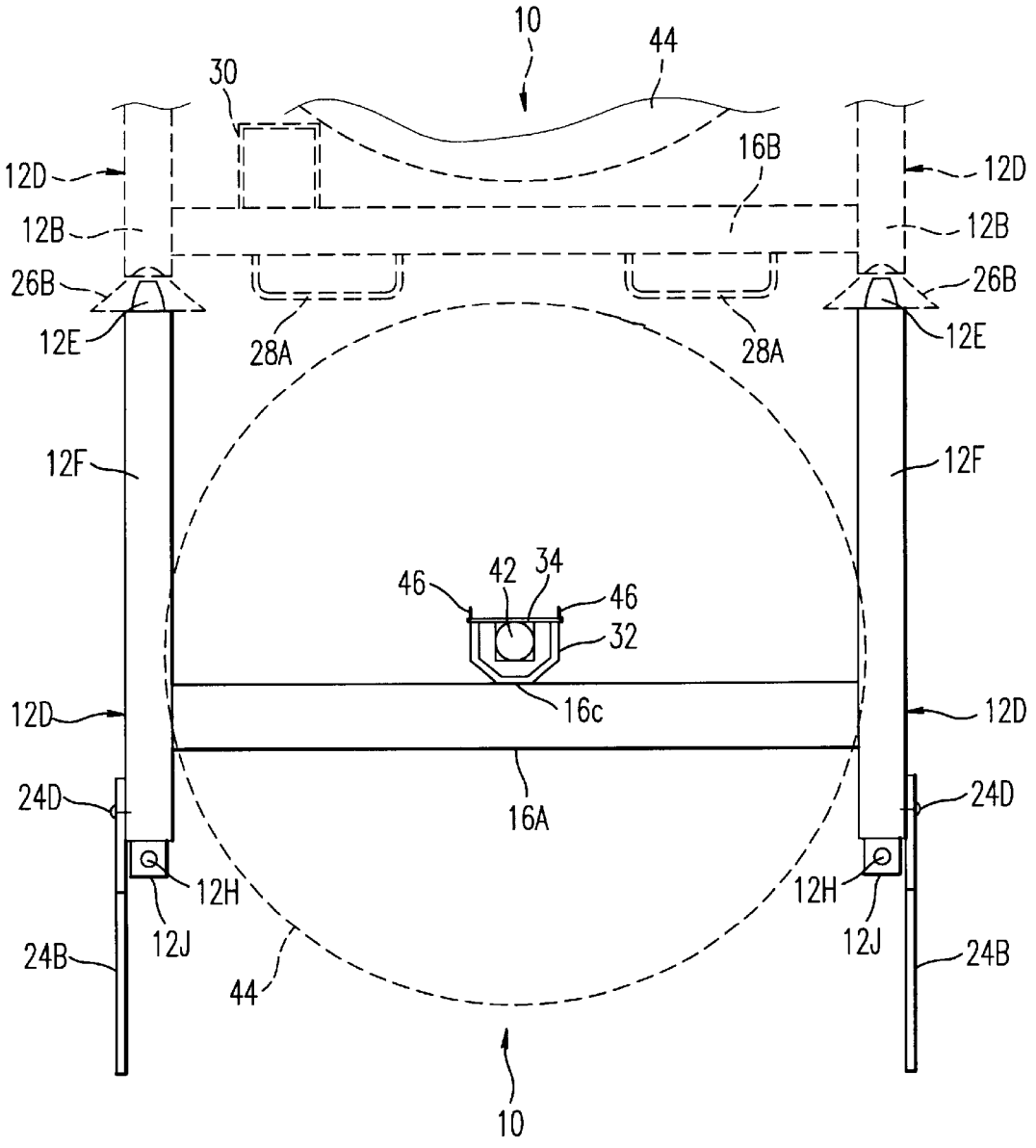
FIG. 5 is an end view of the invention in use.

In FIG. 5, the rack 10 is seen in use in an end view. The upper ends 12F of the corner posts 12D are connected together by the upper end bar 16A which carries on top at its horizontal center 16C the cradle 32 with a deep inset and the holddown plate 34 fastened thereto. A central mandrel 42 of a large roll 44 of mechanically sensitive goods, such as paper or yarn, rests completely in the deep inset of the cradle 32. Each heavy roll 44 is lifted at opposite ends of the mandrel 42 by either a crane or a forklift and is lowered into position in the inset of the cradle 32. The holddown plate 34 is then fastened on top of the cradle 32 by pins 46 so that the mandrel 42 is secured in the inset of the cradle 32 in order to prevent it from jumping out in the event that the rack 10 suffers a strong external shock. Above the roll 44, another rack 10 is partially visible with the foot plates 26B of the bottom ends 12B of the corner posts 12D nestled over the top end pins 12E. The lower end bar 16B is seen in phantom lines and connects the adjacent bottom ends 12B together. Brackets 28A extend below the lower end bar 16B to receive prongs of a forklift (not shown) and allow an operator to remove a rack 10 safely. At the bottom of each upper end 12F of the corner posts 12D, there are the blocks 12J through which the bore holes 12H are drilled. The hinge plates 24B are also shown at the bottom of FIG. 5 with the top hinge pins 24D which attach the hinge plates 24B to the corner posts 12D. The box 30 prevents the roll 44 from shifting in the rack 10.

Clearly, numerous modifications and variations of the present invention are possible in light of the above teachings. Thus, it is to be understood that, within the scope of the appended claims, the invention may be practiced otherwise than as specifically described herein.

I claim:

1. A collapsible and stackable pallet rack, for shipping and storing heavy roll goods having a central mandrel, said rack comprising:

a. two pairs of adjacent and opposite upright corner posts being foldable inwardly and downwardly;

b. two side bars connecting together the pair of opposite upright corner posts;

c. two pairs of upper and lower end bars, each pair of end bars connecting together one pair of adjacent upright corner posts;

d. a pair of cradles, each cradle being positioned centrally on top of each upper end bar for receiving one end of the central mandrel;

e. a holddown plate fastened on top of each cradle;

f two pairs of hinge plates connecting the two pairs of corner posts with the two side bars;

g. two middle bars running parallel to the two side bars and connecting the pair of lower end bars;

h. a plurality of cross braces connecting each middle bar to the side bar adjacent thereto;

i. at least one middle brace connecting the two middle bars together at their centers; and j. a box mounted on top of each lower end bar in order to prevent the heavy roll goods from shifting in the rack;

wherein each one of the corner posts is separable at a seam into an upper end and a bottom end, said upper end being carried by one of the hinge plates and having a mating block depending therefrom;

whereby a rigid bed-like structure is formed.

2. A collapsible and stackable pallet rack, according to claim 1, further comprising:

a pair of brackets secured below each lower end bar and another pair of brackets secured below each side bar, said brackets being capable of receiving prongs of a forklift.

3. A collapsible and stackable pallet rack, according to claim 1, wherein:

each upper end has a top end pin and each bottom end has a trapezoidal foot plate capable of nesting on top of the top end pin of the upper end of the corner post of an underlying rack.

4. A collapsible and stackable pallet rack, according to claim 1, wherein:

each mating block of each upper end has a hole bored therethrough and each bottom end of the corner post has a hole bored therethrough for alignment with the hole bored through the mating block.

5. A collapsible and stackable pallet rack, according to claim 4, further comprising:

a cotter pin retained by a wire secured to each bottom end, said cotter pin being insertable into the aligned holes bored through the bottom end and the mating block of the upper end of each corner post.

* * * * *